United States Patent [19]

Oliver et al.

[11] 4,428,317

[45] Jan. 31, 1984

[54] REINFORCED OPENING

[76] Inventors: Emerson T. Oliver, 239 Ocean Ave., Marblehead, Mass. 01945; Brian P. Doyle, 6 Whittier Pl., Boston, Mass. 02114; Philip R. Marriner, 182 Cedar St., Wellesley Hills, Mass. 02181

[21] Appl. No.: 295,534

[22] Filed: Aug. 24, 1981

[51] Int. Cl.[3] ..... B63H 9/08; A43C 5/00

[52] U.S. Cl. ..... 114/114; 24/141

[58] Field of Search ..... 114/114, 115; 24/141, 24/142, 266

[56] References Cited

U.S. PATENT DOCUMENTS

| | | | |
|---|---|---|---|
| 1,481,217 | 1/1924 | Maloy | 24/141 |
| 2,123,722 | 7/1938 | Frichenfield | 24/141 |
| 2,143,087 | 1/1939 | Rau | 24/141 |
| 2,330,192 | 9/1943 | Bednarek | 24/141 |

*Primary Examiner*—Sherman Basinger
*Assistant Examiner*—C. T. Bartz
*Attorney, Agent, or Firm*—Robert T. Gammons

[57] ABSTRACT

A reinforced opening for sail cloth, tarpaulins, tent material, awnings and the like sheet material comprising a bead surrounding the opening comprised of a rigid ring positioned about the opening and enfolded within material bounding the opening and a liner positioned within the enfolded ring folded symmetrically outward over the bead at opposite sides into clinching engagement with the surface of the material outwardly of the bead.

9 Claims, 13 Drawing Figures

REINFORCED OPENING

BACKGROUND OF INVENTION

The provision of reinforcing rings around openings in sheet material and, in particular, to sail cloth is old in the art as shown in U.S. Pat. Nos. 3,653,353; 3,683,844; 3,812,809; 3,979,798; and 3,890,695. It is the purpose of this invention to improve upon the structure shown in the aforesaid patents by providing a structure which will distribute the load as efficiently as any structure shown in the aforesaid patents, but which will be less prone to cracking and stripping under strain, which will be much lighter in weight, which can be made of a material which will not corrode and which will be less expensive to manufacture.

SUMMARY OF INVENTION

As herein illustrated, the cringle structure is designed especially for sails; however, it is equally useful for tarpaulins, awnings, tent material and like sheet material and comprises a ring positioned about the opening at one side of the material with a width of the material bounding the opening folded from said one side through the opening and outwardly about the ring, said ring enfolded by said width of material at the edge of the opening constituting a bead bounding the opening and a liner positioned within the opening bounded by the bead with portions folded symmetrically outwardly over the surfaces of the bead at opposite sides into clinching engagement with the opposite surfaces of the sheet outwardly of the bead. The ring is substantially incompressible, is desirably of a cross section such as to provide edges running peripherally thereof, may be comprised of high-impact plastic or metal and is of larger diameter than the opening. The tubular insert is of such smaller outside diameter that when placed within the ring, there is a clearance between the ring and the liner corresponding substantially to the thickness of the material bounding the opening. The sheet material in the area of the opening may optionally be of multi-ply construction.

In another aspect, invention resides in the method of inserting a cringle in sheet material such as sail cloth comprising forming an opening in the material, positioning a rigid ring at one side of the material about the opening, folding the material bounding the opening from the one side through the ring and about the ring at the opposite side, positioning a tubular liner element within the opening and folding the protruding ends of the tubular liner element outwardly about the enfolded ring into frictional engagement with the opposite sides of the material bounding the opening. In accordance with the method, the opening is of smaller diameter than the inside diameter of the ring and the material bounding the opening is radially slitted so that the locus of the extremities of the slits define a circle of a diameter corresponding substantially to the inside diameter of the ring.

The invention will now be described in greater detail with reference to the accompanying drawings, wherein.

Figure 1:
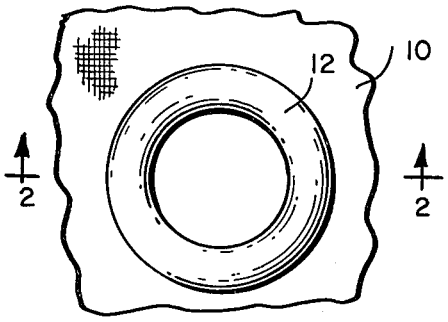
FIG. 1 is a plan view of a portion of the sail provided with a cringle attachment according to this invention.

Referring to the drawings, FIG. 1, there is shown in plan a portion of a sail 10 or other sheet material to which a cringle 12 is applied according to this invention. The cringle may be applied at any appropriate point and, desirably, in the area where the cringle is applied, the material is of multi-ply thickness.

Figure 2:
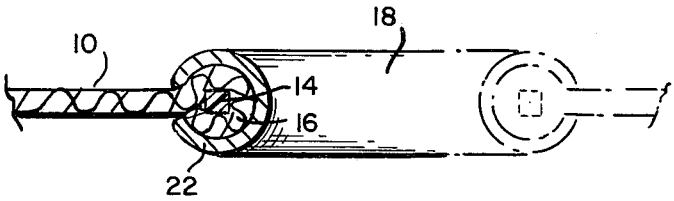
FIG. 2 is a sectional view taken on the line 2—2 of FIG. 1.

As illustrated in FIG. 2, the cringle comprises a core ring 14, a bite 16 of the material of the sail folded from one side of the core ring through the ring and about the other side and a liner 18 positioned within the opening with portions 20 and 22 folded over the ring 14 into clinching engagement with the opposite sides of the sail material.

Figure 3:
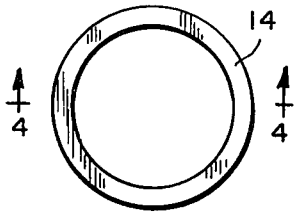
FIG. 3 is a plan view of a ring member.
Figure 4:
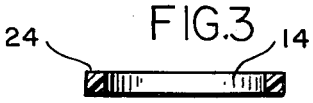
FIG. 4 is a diametral section of the ring member shown in FIG. 3.

The core ring 14, FIGS. 3 and 4, is comprised of a rigid, high-impact plastic of rectangular cross section; however, it is to be understood that it can be made of metal. Desirably, the core ring 14 is sufficiently rigid so that it does not become deformed substantially under compression and so that the edges 24 remain sharp.

Figure 5:
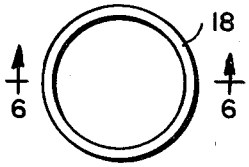
FIG. 5 is a plan view of a liner sleeve.
Figure 6:
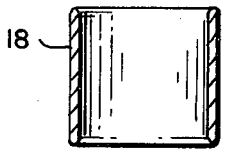
FIG. 6 is a diametral section taken on the line 6—6 of FIG. 5.

The liner 18, FIGS. 5 and 6, is a tubular sleeve comprised of stainless steel or its equivalent.

Figure 7:
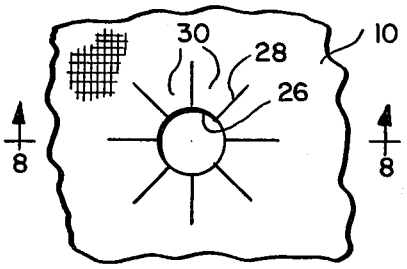
FIG. 7 is a plan view of a portion of sheet material showing the initial step in preparing for applying the cringle.
Figure 9:
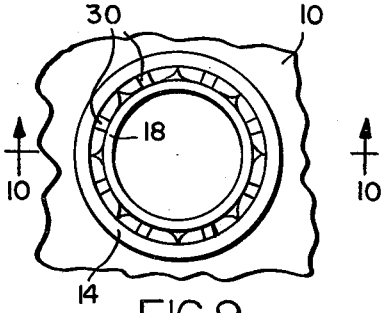
FIG. 9 is a plan view simular to FIG. 7 showing a second step in installing the cringle.
Figure 8:
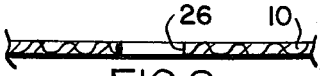
FIG. 8 is a section taken on the line 8—8 of FIG. 7.
Figure 10:
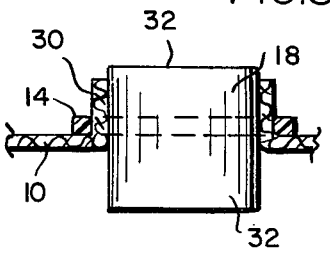
FIG. 10 is a section taken on the line 10—10 of FIG. 9.
Figure 11:
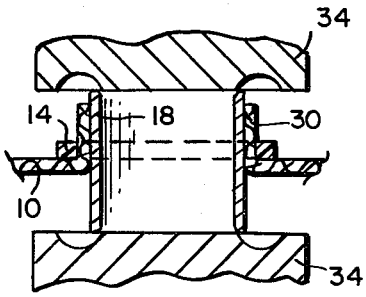
FIG. 11 is a section similar to FIG. 10 showing the initial step in folding the lining outwardly.
Figure 12:
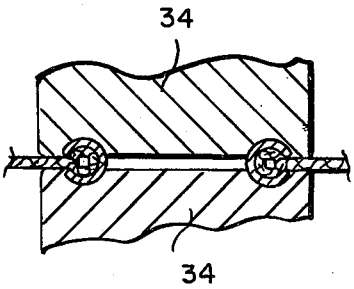
FIG. 12 is an elevation showing the final step of folding the liner into engagement with the opposite surfaces of the material.

The cringle is assembled as follows. First, as shown in FIG. 7, an opening 26 is formed in the sail cloth through the several plies together with a plurality of circumferentially-arranged, radially-extending slits 28. The core ring 14 is now placed on the sail cloth in concentric relation to the opening 26 as shown in FIG. 9 and the portions 30 defined by the slits 28 are folded through the core ring as shown in FIGS. 9 and 10. The liner sleeve 18 is now placed in the opening 26 defined by the upwardly-folded portion 30. The outside diameter of the liner sleeve 18 is smaller than the inside diameter of the ring 14 by an amount corresponding to the thickness of the material of the sail. The protruding ends 32—32 of the liner sleeve are now folded outwardly and downwardly as shown in FIG. 12 by dies 34—34 to bring the end edges of the sleeve into clinching frictional engagement with opposite sides of the sail cloth.

By making the core ring 14 of a rigid, substantially incompressible material so that the edges 24—24 remain unblunted when the liner is folded about the enfolded ring and applying sufficient pressure, the edges 24—24 become embedded in the material of the sail folded about the core ring so as to produce a high degree of frictional resistance to slippage.

Figure 8A:
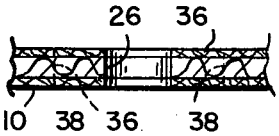
FIG. 8A is a section showing a multi-ply construction in the area of the cringle.

Desirably, the area or areas which are to be reinforced with the cringle structure thus described may be provided with one or more plies 36 at one or both sides, FIG. 8A, as by stitching 38.

An advantage of the structure herein described resides in the fact that the parts need not be precast as are the parts which comprise the makeup of some of the cringles shown in the prior art, which parts are apt to crack under pressure and may be made up of stainless steel which is particularly resistant to corrosion. Furthermore, since the core ring itself is comprised of plastic and the liner of stainless steel and, therefore, need not be of such heavy gauge as is required in the making of castings, the entire cringle is relatively light in weight, which becomes an advantage where the rings are large and a number of rings are used.

It is to be understood that while the cringle is designed specifically for sails, it is equally useful for reinforcing holes in other sheet material such as tarpaulins, awnings, tent material and the like.

What is claimed is:

1. A reinforced opening in sheet material comprising a rigid ring of multi-sided cross section wherein the intersection of the sides define edges spaced about the cross section, said ring being positioned about the opening at one side of the sheet material with a width of the sheet material bounding the opening folded from the one side through and outwardly of the ring at the other side, said ring enfolded by said width of sheet material at the edge of the opening constituting a bead bounding the opening and a liner element positioned within the opening bounded by the bead with portions folded symmetrically outwardly over the surfaces at opposite sides of the bead into clinching engagement with the opposite surfaces of the sheet outwardly of the bead and clinching the folded sheet in engagement with the edges of the ring.

2. A reinforced opening according to claim 1 wherein the rigid ring is of rectangular cross section.

3. A reinforced opening according to claim 1 wherein the width of sheet material folded about the ring is provided with peripherally-spaced, radially-positioned slits.

4. A reinforced opening according to claim 1 wheren the sheet material is reinforced peripherally of the opening with layers of sheet material at one or both sides.

5. A reinforcement according to claim 1 wherein the ring is a high-impact plastic.

6. A grommet assembly for reinforcing an opening in sailcloth comprising, in combination, a rigid ring of larger diameter than the opening of multi-sided cross section defining edges spaced about the cross section and a metal tubular liner of smaller outside diameter than the ring so that when placed within the ring there is a clearance between the ring and the liner sleeve corresponding substantially to the thickness of the sailcloth bounding the opening for receiving a width of the cloth sufficient to be folded through the ring and outwardly on itself about the ring, said liner having end portions projecting from the sailcloth folded outwardly about the enfolded ring pinched against the sailcloth outwardly of the enfolded ring and pinching the folded portion of the sailcloth against the edges of the ring.

7. A grommet assembly according to claim 6 wherein the ring is high impact plastic.

8. A grommet assembly according to claim 6 wherein the ring is stainless steel.

9. A method of inserting a cringle in sheet material such as sailcloth comprising forming an opening in the material of a predetermined diameter, forming radial slits in the material about the opening, positioning a rigid ring of multi-sided cross section defining peripherally-spaced edges about its cross sections and having an inside diameter greater than the diameter of the hole, folding the slitted marginal edge of the material about the opening from the one side through the ring and outwardly about the ring at the other side, positioning a liner sleeve having an outside diameter corresponding to the inside diameter less the thickness of the material in the opening, with its opposite ends extending equal distances from opposite sides of the opening and folding the protruding ends of the liner sleeve outwardly about the enfolded ring into frictional engagement with the opposite side of the material folded about the ring and pinching the folded material against the edges of the ring.

* * * * *